United States Patent [19]

Fischer et al.

[11] Patent Number: 4,779,783

[45] Date of Patent: Oct. 25, 1988

[54] DEVICE FOR REMOVING AN ENDLESS PAPER WEB AND INTRODUCING SAME INTO A FAST PRINTER

[75] Inventors: Werner Fischer; Rolf Schmidt, both of Waldbronn, Fed. Rep. of Germany

[73] Assignee: Suka Suddeutsche Spezialkdruckerei Hermann Jung GmbH, Rheinstetten, Fed. Rep. of Germany

[21] Appl. No.: 825,602

[22] Filed: Feb. 3, 1986

Related U.S. Application Data

[63] Continuation-in-part of Ser. No. 782,547, Oct. 10, 1985, abandoned.

[51] Int. Cl.[4] ..... B65H 20/02; B65H 23/04

[52] U.S. Cl. ..... 226/168; 226/11; 226/188; 226/189; 226/190

[58] Field of Search ..... 226/188, 189, 190, 197, 226/168; 101/228, 222, 223, 178, 179

[56] References Cited

U.S. PATENT DOCUMENTS

| | | | |
|---|---|---|---|
| Re. 31,210 | 4/1983 | Lapp et al. . | |
| 2,021,560 | 11/1935 | Lira . | |
| 2,733,061 | 1/1956 | Crafts . | |
| 3,013,513 | 12/1961 | Judelson | 226/197 X |
| 3,206,089 | 9/1965 | Huck . | |
| 3,339,817 | 9/1967 | French . | |
| 3,464,610 | 9/1969 | Koning . | |
| 3,548,783 | 12/1970 | Knapp . | |
| 3,829,065 | 8/1974 | Less . | |
| 3,906,855 | 9/1975 | Laursen . | |
| 3,912,196 | 10/1975 | Kreutze et al. . | |
| 3,954,213 | 5/1976 | Anderson . | |
| 4,154,386 | 5/1979 | Kawada | 101/223 X |
| 4,385,716 | 5/1983 | DeRoeck et al. | 226/197 X |
| 4,403,718 | 9/1983 | Nagano . | |

*Primary Examiner*—Stuart S. Levy
*Assistant Examiner*—Lynn M. Sohacki
*Attorney, Agent, or Firm*—Antonelli, Terry & Wands

[57] ABSTRACT

An apparatus for removing an endless paper web folded in a large stack and for feeding the paper web to the printing unit of a high-speed printer, particularly a laser printer applying a removal force, at least above stack and in the removal direction behind the same and in front of the printing unit of the high-speed printer is positioned at least one guide roller. At least one of the guide rollers also serves as a deflection roller and for reducing the removal force and, consequently, prevent the risk of the paper web tearing. At least one deflection roller is provided with an additional continuous drive.

14 Claims, 4 Drawing Sheets

DEVICE FOR REMOVING AN ENDLESS PAPER WEB AND INTRODUCING SAME INTO A FAST PRINTER

This application is a continuation-in-part application of U.S. application Ser. No. 782,547 filed Oct. 10, 1985 now abandoned.

BACKGROUND OF THE INVENTION

The invention relates to an endless paper web folded in a stack and for feeding the paper web to the printing unit of a high-speed printer, particularly a laser printer applying a removal force and with paper web guide and removal rollers, whereof at least one is driven.

In printers for large computers and the like, namely laser printers, working takes place with a considerable working speed predetermined by the computer. The printer has paper stack shafts, in which can be placed the endless paper to be printed and located in cartons and is then threaded into the actual printing unit by a printer or supply shaft. The stacks are placed in cases in such a way that each individual sheet to be printed is defined by perforations and, in this manner, separably connected to the next sheet, with the individual sheets being directly superimposed in zig-zag manner and each perforation being folded over. As such computer paper stacks are transported by hand and must, in particular be manually transferred from a pallet to the printer, the stacks can only have a certain weight and, consequently, only a certain number of paper layers. The capacity of the high-speed printer can, consequently, not be fully utilized, because in the case of such printers it is necessary after a short time period to insert a new paper stack, which has to be threaded into the printing unit. This leads to long laser printer down times preventing a complete utilization of the printing speed of the printer and the capacity thereof. Attempts have been made to replace the preperforated paper stacks by rolls, but the latter are very heavy and voluminous, so that they generally require a completely different mounting support arrangement and transport conditions. A further disadvantage is that as a result of the lack of prefolding, the forms can no longer be easily placed in a stack and instead must be separated by tear-off or cutting equipment. The possible paper roll slope caused by the rolling up of the paper web may lead to difficulties in this case. Furthermore, during rolling up, the printing ink printed on the forms is sealed in a relatively air-tight manner, so that a completely satisfactory drying of the print is not ensured. During the burn-in process performed at high temperatures in connection with laser printers, this can lead to the evaporation of ink constituents and, consequently, to undesired contamination effects at the burn-in station. Ultimately a considerable amount of technical effort and expenditure is required for the roll suspension and movement upstream of the high-speed printer, as well as for the necessary tear-off or cutting equipment.

It has already been proposed to leave several, e.g. two raiseable "small stacks" in their cartons on a support plate and which are insertable in the printer shaft, whereby a device provided in addition to the printer and arranged on a base plate and after removing the door closing the printer paper stack shaft can be partly inserted into the latter, whereby the paper web is removed from the stacks and introduced into the printer.

Admittedly the individual small stacks no longer have to be raised into the printer shaft, but through the use of such small stacks the capacity continues to be limited, because the device has only a limited height, so that higher stacks cannot be inserted. Quite apart from the fact that the removal process has to be continuously monitored by somebody or, if this is not done, the paper web is drawn into the paper shaft, and it is only possible to establish therein the paper web end by a detector arrangement, so that the connection with the next web can only take place in a complicated manner, it is a considerable disadvantage of the known device that the stack shaft door provided for noise reduction purposes cannot be closed. Thus, operation leads to a considerable noise level. Furthermore, although in the known device driven rollers are provided, they must also be stopped at least in the case of a prolonged shutdown of the printer, because as a result of the guidance of the paper web over at least one of the driven rollers, there would otherwise be an undesired paper accumulation through the further conveying of the paper in the vicinity of the driven rollers, but lack of a continuing removal in the printer, which can lead to a displacement of the web in the deflection zone and to faults. A further disadvantage is that, as the complete device is partly inserted in the printer shaft on a common base plate, the same is no longer accessible for enabling, for example, changing the printing paper and, for example, direct printing from the paper stack shaft. Thus, the known device suffers from lack of flexibility and a large number of disadvantages, quite apart from the fact that at the best it can be used in a single known printer type, namely the IBM 3800, but not in other printers and due to the inflexibility, can hardly be used in future high-speed printers.

The invention is based on the aforementioned apparatus and sets the problem of providing an apparatus which, while avoiding the aforementioned disadvantages, flexibly has numerous possible uses and combinations with different printers, while considerably reducing noise. In addition, the tensile forces acting on the paper web are reduced and an undesired tearing of the paper web prevented.

In an apparatus of the aforementioned type, this problem is solved in that the paper web is guided below the driven roller, with the driven roller having its own drive and being continuously driven, even when the printer is stationary. A roller deflecting the paper web in the horizontal direction of travel is arranged directly behind the paper stack in its lower zone above the punching base, with the paper web being introduced into the printer with a horizontal transverse extension. At least one intake roller is arranged above the punching base and introduces the web into the printer and the deflection roller provided in the vicinity of the stack has a variable relative spacing.

As a result of the inventive construction, the aforementioned disadvantages of the known apparatus are avoided, because the removal and introduction units of the inventive apparatus are spatially variable, so that the complete apparatus can be used in the most varied way with respect to the printer, without it being necessary to accept other disadvantages. In particular, as a result of the horizontal orientation of the paper web, a noise reduction can be achieved at least on introducing into the printer, either below the lower edge of a sidewall of a printer standing on feet, or through a door slot below the door of a printer or in some other way. As a result of the inventive construction the removal drive arranged on the high-speed printer is given a supporting drive in the vicinity of the paper web travel distance, so that, in the case of a corresponding matching of the drive, the removal force can be applied over a shorter distance, so that the paper web is less stressed A separate drive motor can be provided for the driven deflection roller. Advantageously the driven deflection roller rotates continuously, so that even if the printer is stopped and a removal force is no longer exerted, it still conveys the paper web by a short distance, without there being a large paper web accumulation. When the printer is stationary, due to its guidance, the paper web is directly raised from the same or "drops from it", so that the adhesion between paper web and deflection roller is very rapidly lost and the latter rotates freely.

The continuous deflection roller drive also has the advantage on starting the printer, that at the instant when the paper web is tensioned again, the deflection roller again assumes its supporting drive function. Thus, the removal force acting intermittently on starting is only transferred to the paper web portion located between the printer and the driven deflection roller, while being damped by the gradual application of the paper web to said roller until finally the necessary transfer friction is obtained and it is not transferred into the further paper web. The choice of deflection rollers, which are provided with a drive, will be decided as a function of the particular circumstances, but a driven deflection roller should be positioned in the vicinity of the high-speed printer paper shaft.

In many applications, the paper web removal direction from the large stack differs from the infeed direction into the high-speed printer, so that it is necessary to provide a turning cross, which e.g. optionally comprises an intake roller arranged at right angles to the removal direction, a turning bar positioned immediately behind it and set at an angle smaller than 90° with respect thereto and a further discharge roller arranged at right angles to the infeed direction. Within the turning cross, the turning bar makes it possible to deflect the paper web at right angles to its travel direction e.g. by 90°, while it can also be deflected by the discharge roller in the direction of its extension. According to the invention, when such a turning cross is used, the discharge roller of said turning cross is driven.

The turning cross is generally located directly upstream of the high-speed printer, if e.g. the palletized large stacks are to be set alongside said printer. As a result of the deflection, particularly high frictional forces act on the paper web in the vicinity of the turning cross, so that the risk of tearing is correspondingly high at this point. The arrangement of at least on driven roller in the vicinity of the turning cross, preferably the discharge roller consequently has a particularly advantageous effect at this point.

In order to very effectively transfer the driving force from the driven roller to the paper web, according to a preferred embodiment a guide roller is associated with the driven roller at a limited parallel spacing and the paper web is initially guided over the driven roller and then over the guide roller, while modifying the travel direction between the rollers.

Thus, the paper web is guided between the driven roller and the guide roller in a loop, so that the looping angle necessary for transferring the driving power from the driven roller to the paper web is ensured.

A complicated controlled drive is rendered unnecessary as a result of the continuous feed effect. It is therefore possible to deal with large stacks, as had been proposed in connection with the basic idea of a removal mechanism, but where it was disadvantageously provided for the paper web to be guided through the base, i.e. structural changes where required and in the present case no problems occur in the removal area. Through the drive of the web outside the printer, there is a tensionless transfer, particularly directly over the base, the web optionally being covered. The paper stack shaft and the complete operating side of the printer can be left free, because they do not have to be adjusted by a removal mechanism arranged very close thereto. The operation of the printer is freely ensured.

Further advantages and features of the invention can be gathered from the claims and the following description describing embodiments of an inventive apparatus with reference to the accompanying drawings.

DETAILED DESCRIPTION

Figure 1:
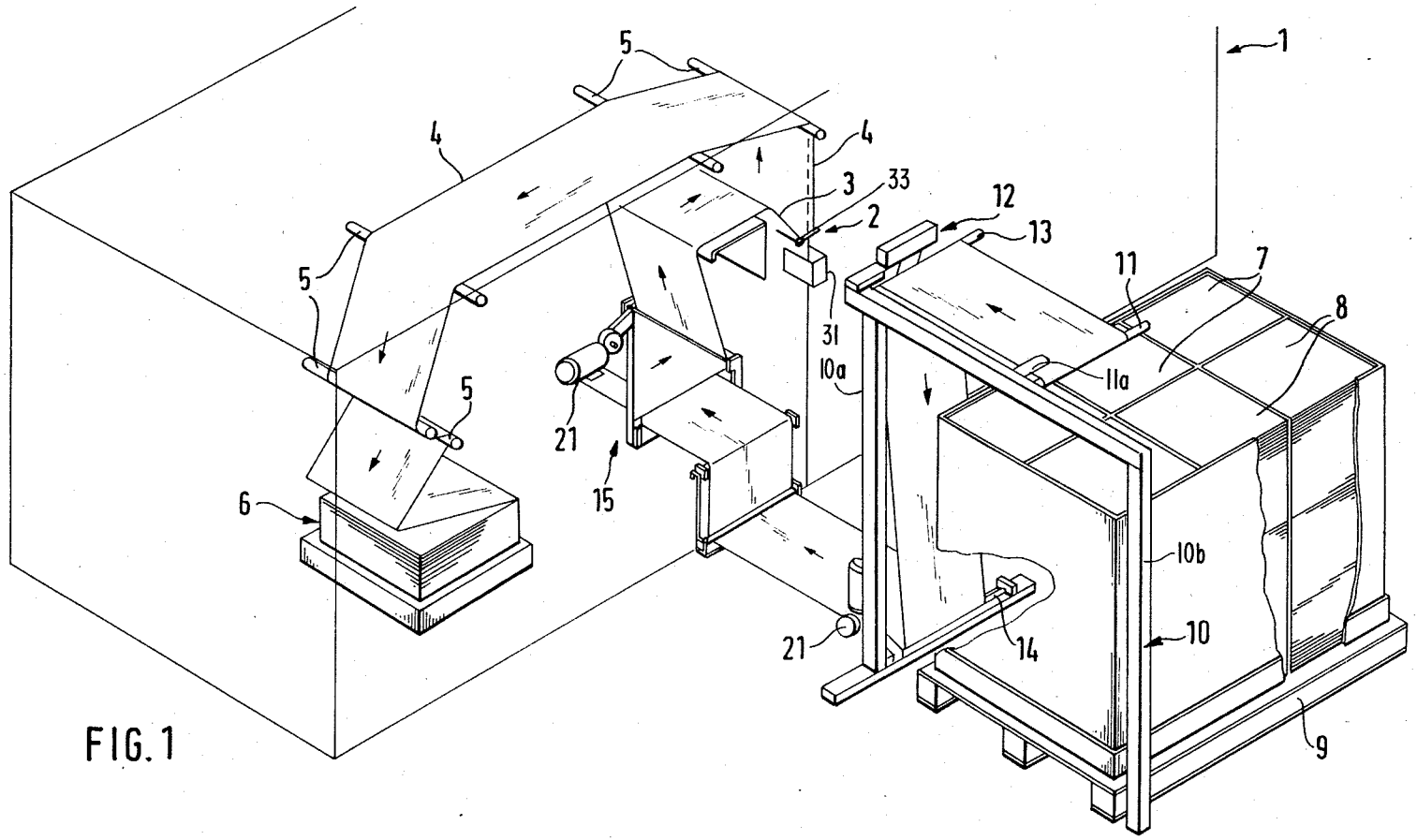
FIG. 1, a perspective view of a high-speed printer with paper supply.

FIG. 1 shows a high-speed printer with its paper stack shaft 2, by which an optionally preprinted paper web 3 can be supplied to a printer from which can be discharged the paper web printed by printer 1. The printing mechanism can also be directly positioned in the upper part of the paper stack shaft 2. The printed paper web 4 runs over several deflection rollers 5 and is continuously placed on a stack 6 in accordance with the format folding of the individual sheets joined together in the paper web 3, so that in the stack each sheet unit is positioned directly above the preceding unit and the paper web 3 is folded in zig-zag-like manner at each preperforation.

The paper supply takes place from large stack 7, which is, for example, arranged on a pallet 9 laterally of the printer. The paper web is positioned in such large stacks so that in each case two or three individual sheets joined by perforations are successively aligned in a plane, i.e. certain perforations are unfolded and only after the second or third or further individual sheet is a perforation folded over in such a way that the travel direction of the paper web 3 is modified. Thus, in the removal or travel direction of the paper web 3, the large stack 7 has a much larger width than that of a sheet unit or the stack 6 deposited in the printer after printing.

The apparatus according to the invention has a removal unit comprising a frame 10, having two vertical posts 10*a*, 10*b* whereof at least one is fixed to a horizontal base 10*c*, the posts 10*a*, 10*b* being interconnected at their upper end by a bridge-like strut 10*d*. The spacing of posts 10*a*, 10*b* and their length and, consequently, the height of strut 10*d* is such that, between posts 10*a*, *10b* and below strut 10*d*, it is possible without difficulty to insert a pallet 9 with a large stack 7. This is important, because several large stacks 7 are juxtaposed on a stack pallet and after one of these stacks has been dealt with, the next must be aligned with the removal unit. Such an individual large stack can have several 10,000 individual sheets, so that the complete height resulting from pallet 9 and the stacks can be more than 1 m.

A reception or removal roller 11 is provided on the strut 10*d* of the removal mechanism 10. Roller 11 is preferably centrally positioned over stack 7 and should be arranged in the central third of the length of stack 7, so that the paper is always taken up under an appropriate removal angle range and without too great a distance from the first roller. There would otherwise be a risk of the paper web 3 sagging (e.g. if web 3 was only taken up by roller 13).

In the vicinity of removal roller 11 is provided a detector arrangement 11*a*, which determines the end of paper web 3 and stops printer 1, for example, by a photoelectric cell 31 provided in paper shaft 2. When the detector arrangement 11*a* responds, the photoelectric cell 31 is directly illuminated by a lamp 33, immediately upstream of the photoelectric cell 31, and is controlled by the lamp and releases a retaining mechanism 12, which still secures the paper web in the region above stack 7, so that the next paper web can easily be joined to the end of the first paper web.

A further deflection roller 13 is arranged in the vicinity of the locking mechanism 12 in the removal direction behind stack 7. Roller 13 deflects the paper web downwards by 90°. It runs behind the stack to the vicinity of the bottom and directly over the latter is deflected again by 90° into the horizontal by a deflection roller 14 (driven by motor 21') where it is ultimately supplied to the paper shaft 2*a* by a turning cross 15, which deflects the paper web at right angles to its previous direction of travel. The paper web 3 initially passes below the lower edge of the side wall of printer 1 and then in the represented embodiment (due to the specific printer) is guided in stepwise manner into paper shaft 2.

Paper web 3 is fundamentally introduced with a horizontal transverse extension into paper shaft 2, i.e. the web width extension direction given by the vertical feed direction is horizontal, as is apparent in FIG. 1. This has the advantage that the paper shaft 2 still has a free space, e.g. above the turning cross in FIG. 1, which only has a height of approximately 10 cm, in that e.g. a small stack is placed on a base and is intermediately printed without any complicated conversion work. If the paper web 3 is directly introduced into the operating opening of the paper shaft 2, then with the web alignment according to the invention this can take place below the shaft door and consequently the latter remains closed during printing, which is necessary for noise reduction purposes. In the case of a paper web 3 entering with a vertical transverse alignment, the door cannot be closed and there is a considerable noise level in operation. If, as stated hereinbefore, the paper web 3 is introduced into the paper shaft 2 below the lower edge of the printer 1, the door thereof can also remain closed during operation, so that there is no unreasonable noise level. This introduction is also not possible with a vertical transverse extension of the web.

Figure 3:
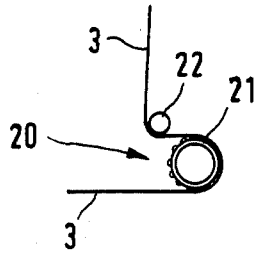
FIG. 3, a diagrammatic front view of the arrangement in the vicinity of the turning cross discharge roller.
Figure 2:
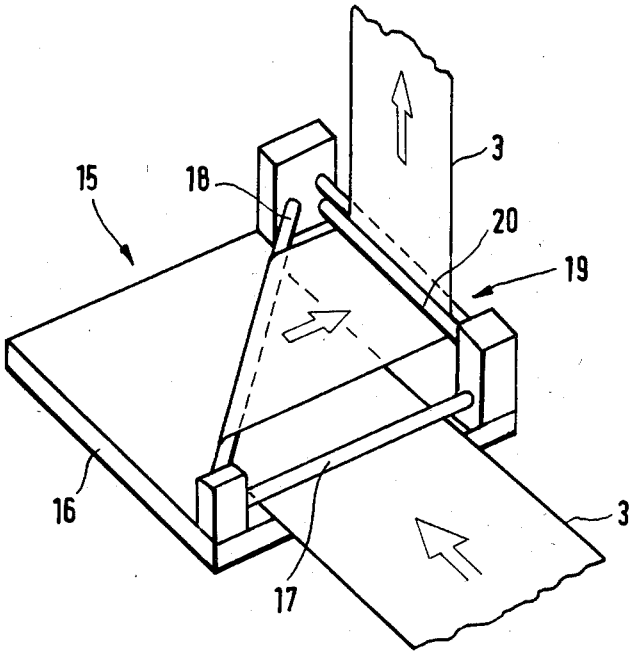
FIG. 2, a perspective detail of a turning cross.

On the turning cross shown in FIG. 2, a guide roller 17 is provided at right angles to the introduction direction of the paper web 3 and prevents an upward deflection of the paper web 3. Immediately behind guide roller 17 and at roughly the same height is provided a guide bar 18 at an angle to the travel direction. This deflects the paper web 3, as is apparent from the direction arrows, by 90° with respect to the rotation direction. In the vicinity of the paper web outlet 19, the turning cross 15 finally has a discharge roller 20, which in the represented embodiment has a self-contained motor drive, designated 21 in FIG. 1. The driven discharge roller 20 is e.g. provided with a rubber or plastic covering to improve the transfer of the driving power or with protuberances as shown in FIG. 3. A further, non-driven guide roller 22 is positioned in displaced manner with respect to the driven discharge roller 20, so that the paper web 3 is deflected several times here and the driven discharge roller 20 engages with a corresponding large looping angle. Finally, behind the guide roller 22, paper web 3 is guided substantially vertically upwards and then optionally via further guide rollers passes to the actual printing unit, optionally via a printer shaft 2*a* of high-speed printer 1.

In addition to discharge roller 20, further rollers can have an independent drive, as shown for deflection roller 14 in FIG. 1. In addition, more than one roller can be driven within the turning cross 15.

Thus, at least one driven roller is provided, which is used for relieving the removal force of printer 1 and leads to the paper web 3 which, due to the inventive apparatus, is supplied over a longer distance to the printing unit than would correspond to the actual printer design, and is supplied in a substantially tensionless manner so that there is virtually no risk of tearing between the removal of the paper web 3 from the paper stack 7 and the introduction into the printing unit of the printer 1. It is also important in the invention that roller 20 and/or 14 is continuously driven by its drive motor 21 and therefore continuously revolves, whereas, the actual printer as a line printer feeds in a discontinuous manner, in that during the printing of a line the paper web 3 is not advanced, but at the end of the line the paper web 3 is advanced to the next line at high speed, where it again stops and is printed. The paper web 3 in the printer 1 is generally conveyed by a spiked or toothed drive. Through the continuous drive of the driven rollers 20 and/or 14 of the apparatus according to the invention, the paper web 3 is tightened by a short portion in the vicinity of the driven roller immediately following the stoppage of the tooled drive, but is loose in the region, so that the driven roller can freely rotate without further feeding or accumulating the paper web 3. As a result of this tolerance produced, the toothed drive is relieved in the printer 1 during the next paper web feed, i.e. it does not have to tighten the complete paper web 3 from stack 7 to the toothed drive, this only being necessary as from the region of the final driven roller (here 21) to the toothed drive. As a result of the continuously revolving roller, if through the feeding of the paper web 3 by the toothed drive a tension is freely exerted on the paper web, the latter is drawn against the driven roller in the vicinity thereof and is then conveyed on by the latter, so that also in this time feed portion of the toothed roller drive, the stack 7 does not have to take up all the tension. This inventive construction prevents a tearing out of the paper web in the toothed or spiked roller drive of printer 1 due to the damaging of the feed holes in which the teeth or spikes of the toothed or spiked drive engage, while there is also no tearing of perforations between borders and the paper area to be printed. Without the driven roller according to the invention, such a tearing out could in particular occur with short-fibre papers.

It is important for permitting a continuous revolution of the driven rollers without there being an excessive paper accumulation behind them through the supply of excessive paper length, e.g. if the printer 1 is stopped for a long time, that the paper web 3 is always passed below the driven roller, as is apparent in connection with rollers 20 and 14 in FIG. 1. Thus, the further supply only takes over a very short time and length, the paper web is relatively rapidly detached from the driven roller and essentially drops therefrom, so that the feed process is interrupted despite the driven roller continuing to rotate. If the paper web is guided over the roller, it would always rest thereon if e.g. roller 13 or the roller in the upper region of the step in FIG. 1 was driven and would be continuously conveyed on until possibly the paper accumulation was so large as to lift up from the roller (e.g. at the roller in the upper stage in the printer of FIG. 1). Such a paper accumulation can lead to considerable faults and damage, so that it is to be avoided, as is made possible by the inventive selection of the driven rollers.

Figure 4A:
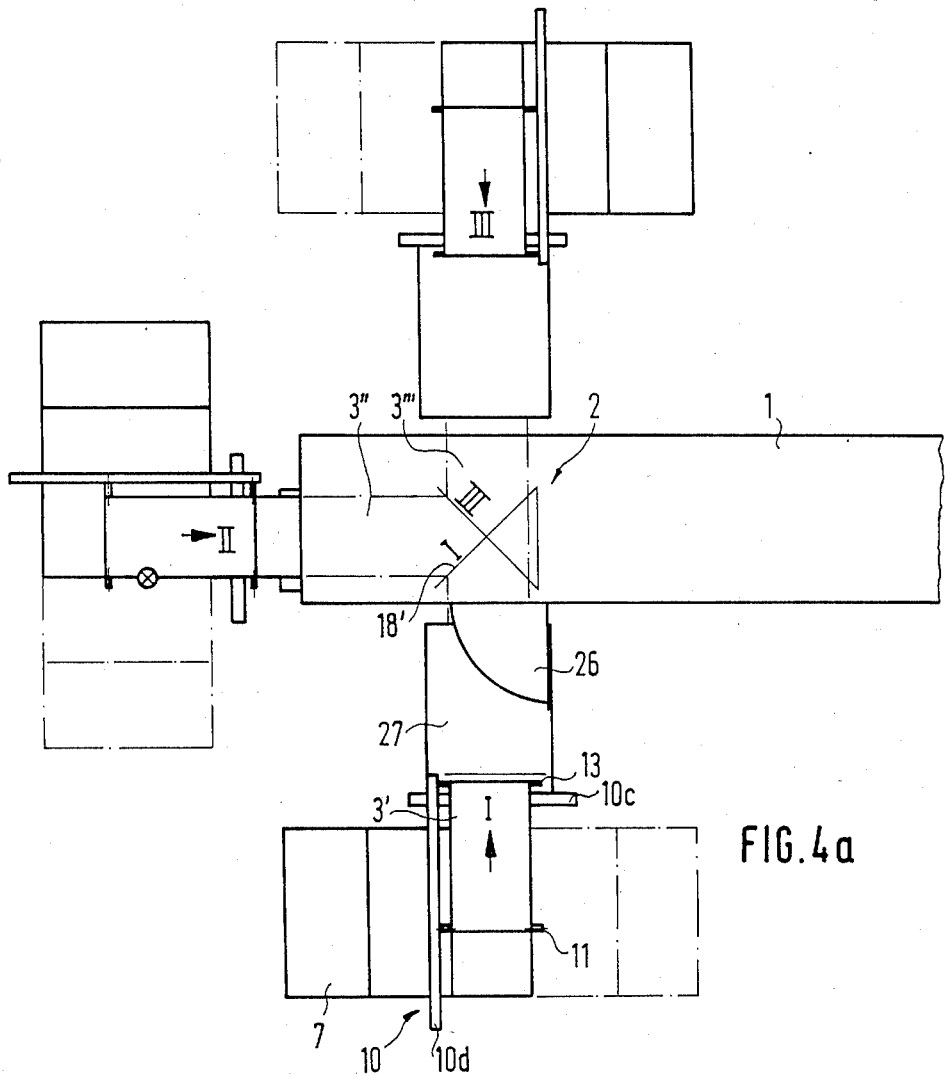
FIGS. 4*a* to 4*d*, diagrammatic installation possibilities of the inventive apparatus with respect to the printer.

FIG. 4*a* shows diagrammatically several combination or association possibilities of the inventive apparatus with a printer 1. In the combination possibility designated I, the removal unit 10 is positioned in spaced lateral manner with respect to the printer 1 on the operating side, so that the paper shaft door 26 can be opened without difficulty. The paper web 3 is introduced into the paper shaft below the door. The distance between the removal unit 10 and the printer 1 and the turning cross located therein with deflection roller 18' is bridged by a base plate 27, which is positioned a few centimeters above the ground. The dot-dash representation of further stacks 7 indicate how the pallet is moved on dealing with individual large stacks 7, so that it can deal with further stacks.

Reference II designates a further arrangement, in which the paper web 3 is introduced into the paper shaft below the printer 1. Here again there can optionally be a considerable spacing with respect to the printer, which is bridged by a base plate 27. Reference III designates a further position of the removal unit facing position I. The base plate could optionally be omitted here and the removal unit moved closer to the printer.

Figure 4B:
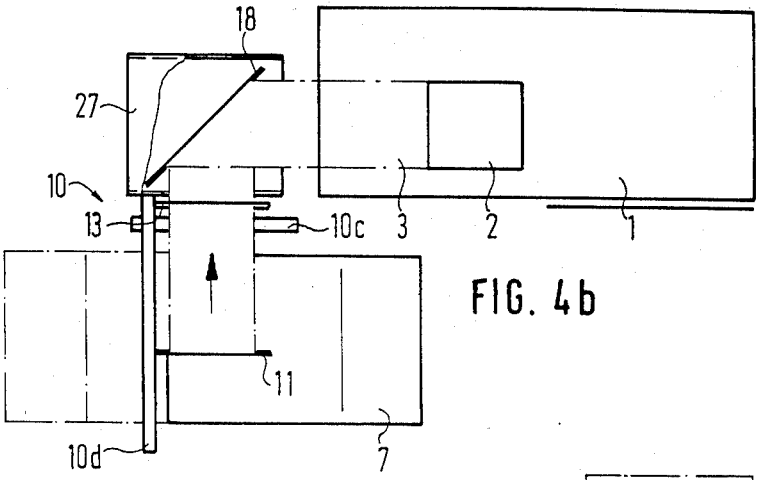

Another combination possibility is shown in FIG. 4*b*, where the removal mechanism is laterally displaced with respect to the printer and a turning mechanism is provided outside the latter. The turning mechanism is preferably covered by a cover plate 27. In the construction according to FIG. 4*c* the web is passed under the entire printer 1, is deflected and introduced on its return over paper shaft 2. Guidance in FIG. 4*d* much as in FIG. 4*c*, but as in FIG. 4*b* there is a turning mechanism, which can optionally be covered by a cover plate 27 and located outside the printer. On the basis of the combination possibilities of FIGS. 4*b* and 4*d*, these could in each be reflected upwards and the deflection could take place by means of the turning mechanism in some other way.

Figure 4C:
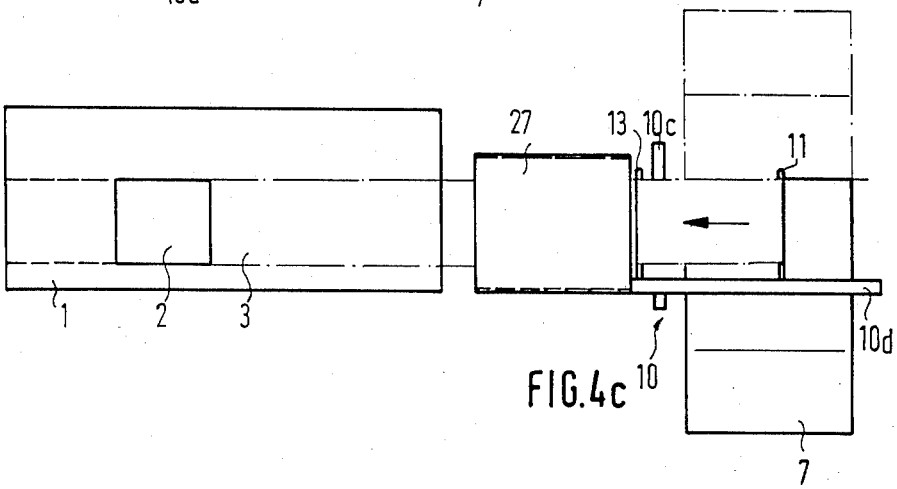
Figure 4D:
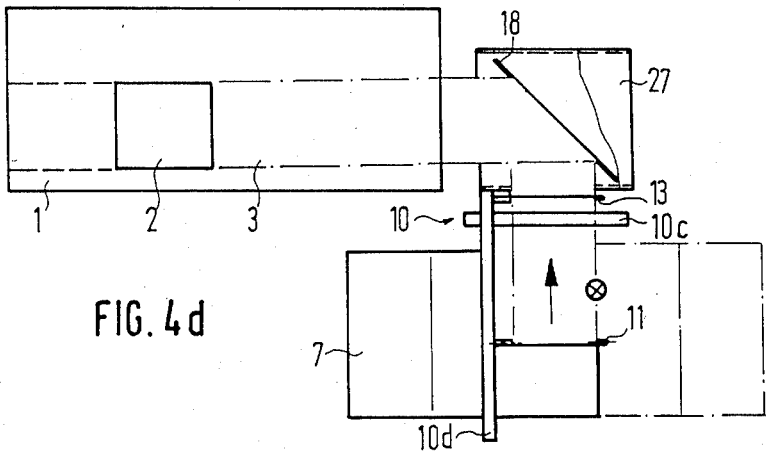

The combination possibilities of FIG. 4*a* are particularly suitable for IBM printer 3800, combination possibilities I of FIG. 4*a* and those of FIG. 4*d* are particularly intended for the Siemens printer ND 2 and ND 3, while the possibilities I of FIG. 4*a* and those of FIG. 4*c* are intended for printer ND 3 RF. With regards to the combination with a printer, the inventive apparatus offers numerous design and modification possibilities, so that it can be used in any new printer type.

We claim:

1. An apparatus for removing an endless paper web folded in a large stack and for supplying the paper web into a printing unit of a high-speed printer applying a removal force on the paper web, at least one web guide roller arranged above the stack, one guide roller in a removal direction downstream of the stack, and one guide roller upstream of a printer paper shaft, at least one guide roller simultaneously serving as a deflection roller for deflecting the paper web in a horizontal direction, and means for driving at least one of said rollers continuously and independently of the printer, said guide roller serving as a deflection roller for the paper web in the horizontal direction is positioned directly behind the paper stack in a lower region thereof above a base with the paper web being introduced in a horizontal transverse plane into the printer, and at least one feed roller is arranged above the base and introduces the paper web into the printer.

2. An apparatus according to claim 1, wherein means are provided for driving the roller deflecting the paper web in the horizontal travel direction.

3. An apparatus according to one of claims 1 or 2, wherein a turning cross means is provided so as to enable the removal direction of the paper web from the large stack to differ from the intake direction into the printer, said turning cross means comprises an intake roller arranged at right angles to the removal direction, a turning bar positioned immediately behind said intake roller and set at an angle less than 90° with respect thereto.

4. An apparatus according to claim 3, further comprising the discharge roller arranged parallel to said intake direction.

5. An apparatus according to claim 4, wherein said means are provided for driving the discharge roller of the turning cross means.

6. An apparatus according to claim 1, wherein a guide roller is associated with the driven roller with a limited parallel spacing, and wherein the paper web is initially guided along the driven roller and then by way of the guide roller while changing a travel direction between the rollers.

7. An apparatus according to claim 6 wherein the driven roller and guide roller are displaced with respect to one another in the travel direction of the paper web and at right angles thereto.

8. An apparatus according to claim 1, wherein at least one of the driven rollers is provided with a covering having a relatively high coefficient of friction.

9. An apparatus according to claim 8, characterized in that the covering of driven roller is a rubber covering.

10. An apparatus according to claim 8, wherein the covering of the driven roller is provided with protuberances.

11. An apparatus according to claim 1, further comprising a detector means arranged in a vicinity of a removal roller, and a lamp means arranged immediately upstream of a photoelectric cell of the printer in the paper shaft of the latter and which is electrically connected to the detector means in such a way that it lights up if the detector means detects an end of the paper web.

12. An apparatus according to claim 11, further comprising a locking device for temporarily locking the paper web, said locking device is arranged behind the detector means in the removal direction of the paper web.

13. An apparatus according to claim 1, wherein said high speed printer is a laser printer.

14. An apparatus according to claim 3, wherein said angle is 45°.

* * * * *